United States Patent [19]

Mayerjak

[11] 4,377,102

[45] Mar. 22, 1983

[54] PIANO CONSTRUCTION

[75] Inventor: Robert J. Mayerjak, Torrington, Conn.

[73] Assignee: Currier Piano Company, Inc., Marion, N.C.

[21] Appl. No.: 259,082

[22] Filed: Apr. 30, 1981

[51] Int. Cl.[3] ..... G10C 3/04; G10C 3/12

[52] U.S. Cl. ..... 84/184; 84/186 WP; 84/187; 84/188; 84/430

[58] Field of Search ..... 84/184, 185, 186 R, 84/186 WP, 187, 188

[56] References Cited

U.S. PATENT DOCUMENTS 1,002,553 9/1911 Bauer ..... 84/187

1,618,521 2/1927 Eilert ..... 84/186 WP

*Primary Examiner*—L. T. Hix

*Assistant Examiner*—Thomas H. Tarcza

*Attorney, Agent, or Firm*—McCormick, Paulding & Huber

[57] ABSTRACT

In a piano a panel, which takes the place of the usual cast iron string plate or frame, is provided for supporting the strings. The panel is a sandwich construction making it exceptionally strong and capable of withstanding the string loads without bending or otherwise yielding and without requiring auxiliary support such as the massive wooden backs or trusses to which cast iron string plates are usually attached. The string panel has a relatively thick low modulus of elasticity core layer, a portion of which is made of laminated hard wood to serve as a pin block, and relatively thin layers of high modulus of elasticity material, such as steel, bonded to the core layer. If desired the string panel may be used as the main frame of the piano to which other major components, such as the soundboard, key bed, side cheeks, housing and feet, are directly attached.

31 Claims, 20 Drawing Figures

PIANO CONSTRUCTION

BACKGROUND OF THE INVENTION

This invention relates to pianos and deals more particularly with an improved piano construction using a novel string panel for supporting the strings and replacing the conventional cast iron string plate or frame, and associated strengthening structure, of prior pianos.

The many strings of a piano create large forces which have to be reacted by their supporting structure, and the provision of a suitable carrying structure capable of bearing these forces without undue bending or other yielding is a continual problem with piano manufacturers. More than one hundred years ago cast iron string plates or frames were introduced and these, in various different forms, have become virtually standard in the industry. These cast iron plates were a significant advance over earlier string supports but nevertheless are subject to a number of drawbacks. For one thing a cast iron plate is itself quite heavy and is usually combined with a heavy auxiliary wooden strengthening structure such as the conventional post and beam back of an upright piano or the conventional wooden beam truss of a grand piano, thereby making the complete piano very heavy and difficult to move.

Another disadvantage of cast iron plates is that the wooden strengthening structure with which they are associated is subject to change with temperature, moisture, age and other environmental conditions so that the forces imposed on the plate by the supporting structure are likely to change and cause warping, bending or twisting of the plate with consequent undesirable effects on the tuning of the strings and other factors.

Also, in the casting of cast iron plates some unpredictable and uncontrollable shrinkage of the metal invariably takes place so that it is difficult or impossible to directly cast into the plate notches, holes or other string locating features which are accurately located relative to one another or to some given reference. Thus, when using cast-in string locating features the strings of different plates may have slightly different locations from plate to plate so as to make it necessary when assembling a piano to individually adjust, by a time consuming manual procedure, parts of the action, particularly the hammers, to the associated string plate.

The general object of the invention is, therefore, to provide a piano construction which includes a means for supporting the strings whereby the strings are firmly and satisfactorily supported while nevertheless avoiding the above stated disadvantages of present cast iron string plates and which string supporting means also achieves other important advantages.

More particularly, it is an object of the invention to provide, in a piano, a string supporting panel which replaces the conventional cast iron string plate or frame and its associated strengthening structure and which string panel is highly resistant to bending, warping, twisting or other deflection under the string loads, is light in weight and is capable of being made at competitive cost.

A further object of the invention is to provide a string panel of the foregoing character in which the string locations are readily accurately determined and are accurately repeatable from panel to panel thereby possibly allowing the hammers or other parts of the action to be preset, if desired, prior to assembly of the action with the string panel.

Still another object of the invention is to provide a piano construction using a string panel of the foregoing character and wherein the construction of the piano is simplified by using the string panel as the main frame of the instrument with other major components of the piano being directly connected to the panel for support.

Still another object of the invention is to provide, in a piano, a string panel of the foregoing character having a truly planar surface which may be used as a reference surface from which measurements may readily be taken or tools supported to accurately locate or position other parts of the piano, as for example, for supporting a router or other tool used to adjust the heights of the bridges, after assembly of the panel with a soundboard, to obtain the desired amount of down-bearing pressure of the strings on the bridges.

A still further object of the invention is to provide a string panel of the foregoing character wherein structure performing the function of a conventional pin block or wrest plank is incorporated in and made an integral part of the string panel.

Another object of the invention is to provide a piano construction permitting, for a given general size of piano, the use of longer bass strings due to the elimination of braces and other obstructions presently found on or in association with most string plates.

A further object of the invention is to provide a piano construction allowing, for a given general size of piano, a larger soundboard than otherwise generally used.

Other objects and advantages of the invention will be disclosed by and evident from the following written description and accompanying drawings describing and illustrating preferred embodiments of the invention.

SUMMARY OF THE INVENTION

This invention resides in a piano string panel for carrying the strings of a piano and made of sandwich construction, such panel comprising a relatively thick core layer of low modulus of elasticity material and two face layers of relatively high modulus of elasticity material bonded to the faces of the core layer. Both the core layer and the face layer may be made of various different materials but in accordance with more narrow aspects of the invention part of the core layer is made of wood or a fiberboard, chipboard, or other composite material including wood particles and another part of it is made of laminated hard wood to provide a pin block, and the two face layers are made of steel or other metal. At portions of the panel receiving large amounts of stress, reinforcing pieces, preferably received in recesses in the core layer, are added and are bonded to both the adjacent face layer and the core layer.

The invention also resides in a piano including a sandwich construction string panel of the foregoing character combined with other parts specifically adapted to cooperate with such string panel.

The invention also resides in a piano including a string panel of the foregoing sandwich construction and wherein such panel forms the main frame of the piano with other major components of the piano being directly connected to it for support.

DESCRIPTION OF THE PREFERRED EMBODIMENTS

Figure 1:
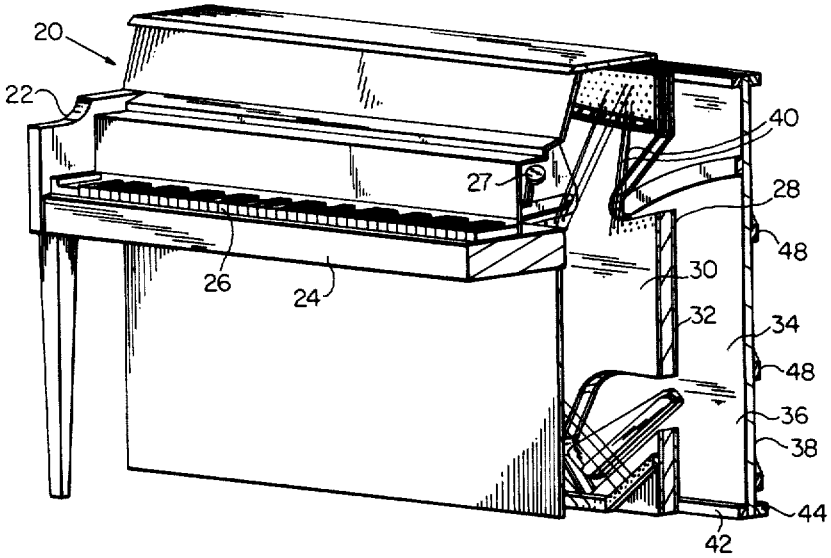
FIG. 1 is a fragmentary perspective view showing a piano embodying this invention.

FIG. 1 shows a piano 20 embodying this invention and which is of an upright style of generally conventional outward appearance. The basic components of the piano 20 include a case or housing 22, a key bed 24 supporting a keyboard 26, an action 27, an upright rectangular string panel 28 with near and far faces 30 and 32, and, behind the string panel 28, a rectangular soundboard 34 with near and far faces 36 and 38.

Figure 2:
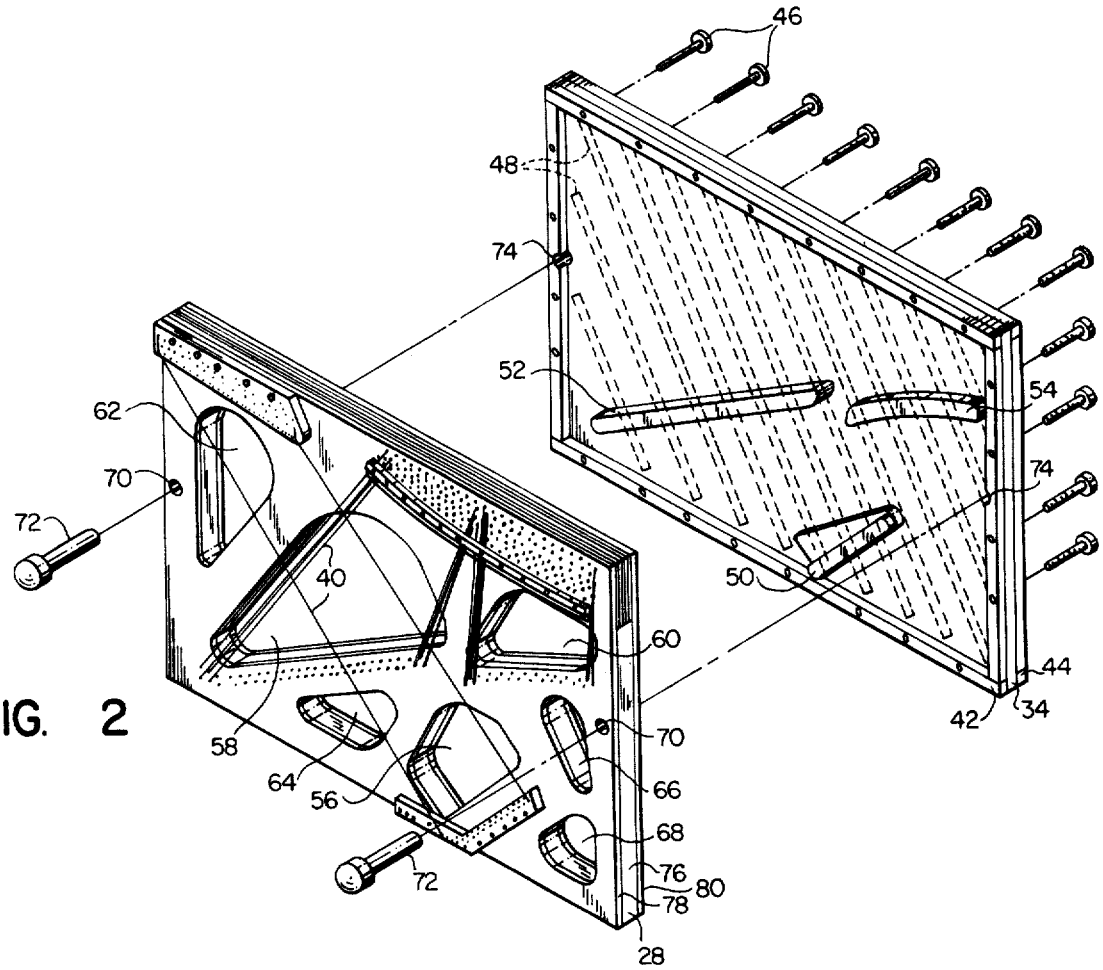
FIG. 2 is an exploded perspective view showing the string panel and associated soundboard of the piano of FIG. 1.

The string panel supports the strings of the piano, some of which are shown at 40, 40, which extend over its near face 30 between associated terminations described in more detail hereinafter. As best seen in FIG. 2, the soundboard 34 is surrounded by a set of near edge strips 42 engaging its near face 36 along the marginal edge portion thereof and by another set of far edge strips 44 which engage the far face 38 along the marginal edge portion thereof. Those surfaces of the edge strips 42 and 44 which engage the soundboard are curved to hold the soundboard in a bellied or crowned condition giving its near face 36 a convex shape and its far face 38 a concave shape. The near set of edge strips 42 engage the marginal edge portion of the string panel 28 and accurately space the soundboard a small distance rearwardly of the string panel, the soundboard in the assembled piano being held to the string panel by bonding, with epoxy resin or the like, and by a number of screws 46, 46 located at regular intervals along the edge of the soundboard assembly, passing through holes in the edge strips and soundboard and threadably received by the string panel. On its far face 38, the soundboard 34 has attached to it a number of inclined ribs 48, 48 in a generally conventional manner.

The soundboard on its near face 36 carries a number of bridges which engage the strings and transmit their vibrations to the soundboard, and the string panel 28 has corresponding openings for accommodating such bridges. The actual number, shape and arrangement of such bridges and of their associated openings in the string panel may vary widely from piano to piano without departing from the present invention. However, in the illustrated case, as shown in FIG. 2, the soundboard 34 carries three bridges—namely, a bass bridge 50, a mid-range or tenor bridge 52 and a treble bridge 54. For receiving these bridges the string panel 28 has openings 56, 58 and 60, respectively, and also includes additional lightening openings 62, 64, 66 and 68. All these openings also serve to allow sound from the near face of the soundboard to pass forwardly through the panel 28.

The string panel 28 also includes, along each of its vertical side edge portions, a bushing providing a horizontal opening 70 through the panel which slidably receives a handle 72, and the soundboard includes two slightly larger openings 74, 74 to allow the handles to pass therethrough. In the completed piano, the handles 72, 72 are movable between a rearward extended position at which the rear portions thereof extend a substantial distance beyond the soundboard 34 and provide a convenient handgrip for use in moving the piano. From this position the handles may be moved forwardly to an inactive or retracted position at which very little or none of them extends rearwardly beyond the soundboard. A suitable stop, not shown, is provided in the piano for limiting the forward movement of each handle 72 and its rearward movement is limited by engagement of its enlarged head with the string panel 28. Movement of the handles from their retracted to their extended position may be accomplished by allowing a small portion of each handle to extend rearwardly beyond the soundboard in the retracted position, which small portion can be grasped by the fingers to pull the handle to the extended position, or the handles can be moved rearwardly by reaching into the piano case and pushing them rearwardly from the near side of the string panel.

Except for the construction of the string panel 28 and soundboard 34 the remaining parts of the piano 20 are or may be of generally conventional construction and need not be described in detail. It should be noted, however, that the string panel 28 serves by itself as the means for supporting the strings 40, 40 and that the piano does not include the usual massive wooden back made of posts and beams conventionally found on other upright pianos, the rear face 38 of the soundboard, with its attached ribs 48, 48, instead forming the rear limit of the piano. There is, therefore, no piano structure to interfere with the transmission of sound from the rear face of the soundboard and because of the omission of the customary massive back the piano may be made, if desired, to have a smaller than usual front to rear dimension.

FIGS. 3 and 5 to 11 show the construction of the string panel 28 in more detail. Turning to these figures, the panel 28, in accordance with the invention, is of sandwich construction including a relatively thick core layer 76, a relatively thin near face layer 78 bonded to the near face of the core layer 76 and a relatively thin far face layer 80 bonded to the far face of the core layer 76. The core layer 76 is made of a material having a relatively low modulus of elasticity in comparison to that of the face layers 78 and 80 so that the panel, due to the high modulus of elasticity of the face panels 78 and 80 and their spacing from one another is very strong and unyielding with respect to the loads imposed on it by the strings.

Figure 3:
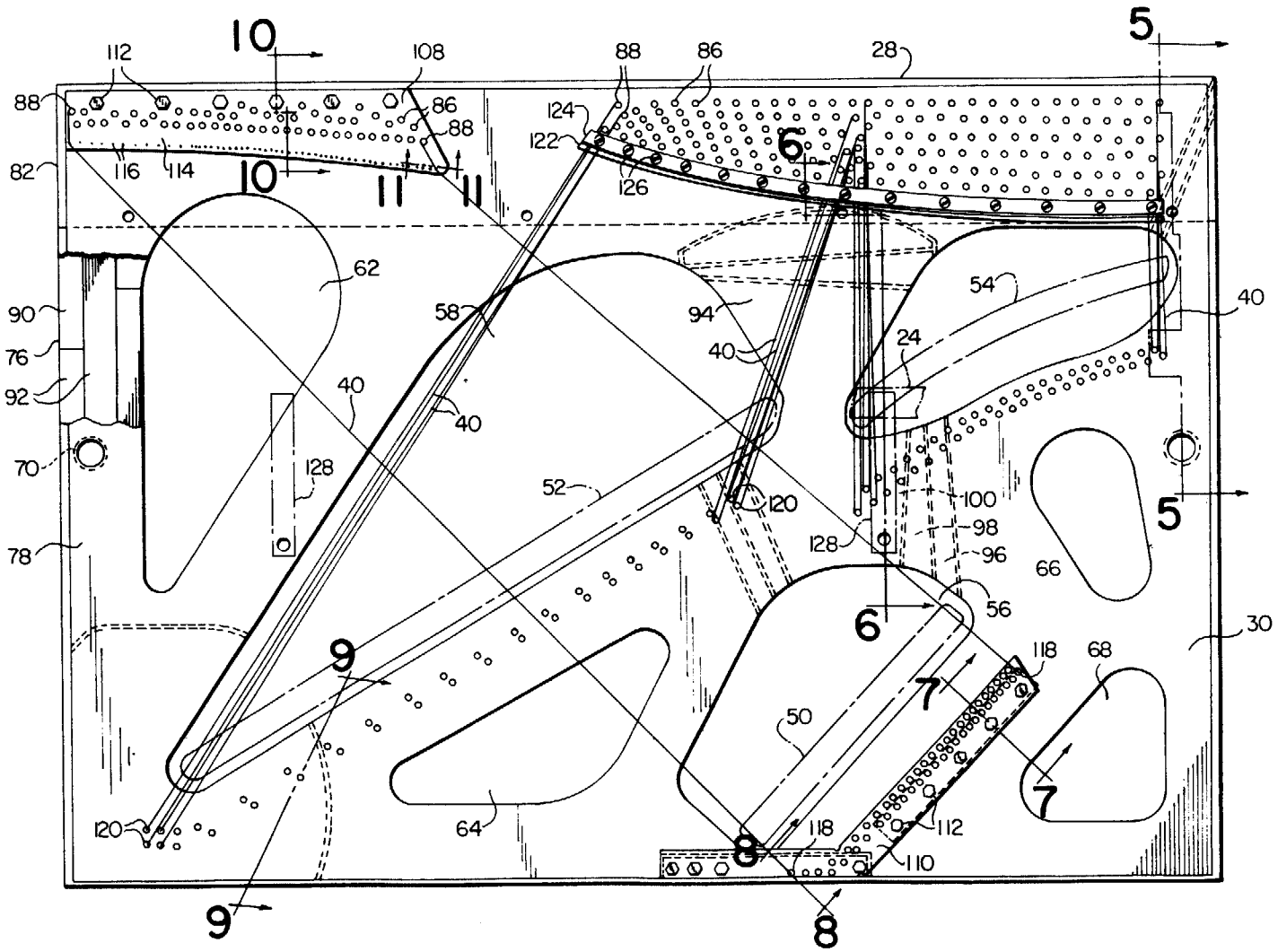
FIG. 3 is a plan view of the string panel of the piano of FIG. 1.
Figure 5:
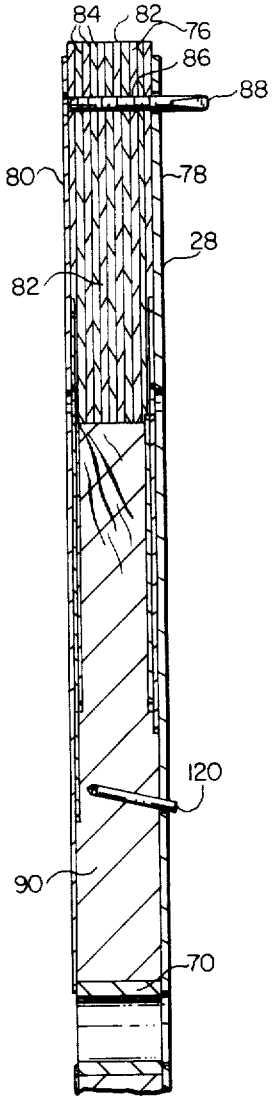
FIGS. 5 to 11 are fragmentary sectional views taken on the lines 5—5 to 11—11, respectively, of FIG. 3.

The materials chosen for the various layers of the panel 28 may vary widely. The core layer 76 along its upper edge, as seen in FIGS. 3 and 5, includes a pin block portion 82 which preferably and as shown is comprised of a plurality of laminations 84, 84 of hard wood, such as maple or birch, and having openings 86, 86 for receiving the tuning pins 88, 88. In FIG. 3 only a few of the tuning pins 88, 88 and their associated strings 40, 40 have been shown, the remainder of the strings and tuning pins having been omitted to show the structure of the panel more clearly. The remaining portion 90 of the core layer is preferably made of wood or of a composite material, such as fiberboard or chipboard, including particles of wood. In the illustrated case, as shown in FIG. 3, the remaining portion 90 of the core layer is comprised of glued-up blocks 92, 92 of solid wood such as poplar.

The face layers 78 and 80 of the panel 28 may be made of a high modulus of elasticity composite material such as fibers of fiberglass, carbon or boron embedded in a resin matrix. However, the face layers are preferably made of metal and most preferably that metal is steel, as is the case with the illustrated layers 78 and 80. An epoxy resin is presently preferably used to bond the steel face layers to the core layer, but other suitable bonding agents may also be used.

The use of steel for the face layers 78 and 80 has the advantage, among other things, that the strings 40, 40, or at least their cores, are also made of steel and therefore the coefficient of thermal expansion of the string panel will exactly match the coefficient of thermal expansion of the strings. The steel layers are so much stiffer than the wooden core that the wooden core has a minor effect on the thermal expansion of the steel layers. Also, the steel layers together with the bonding agent holding these layers to the core layer act to seal those surface areas of the core layer which they engage against the passage of moisture to and from the core layer, and the surface areas of the core layer not covered by the steel layers are coated with a layer of epoxy resin or other sealer so that the core layer is entirely surrounded or faced with a moisture transfer inhibiting material. Of course, the steel layers also resist dimensional changes in the panel due to changes in the moisture content of the core layer which possibly may nevertheless occur.

The string loads on the panel tend to put the near face layer 78 into compression and the far face layer 80 into tension with the compressive loading of the near layer 78 being greater than the tensile loading of the far layer 80, and therefore as shown in FIG. 5, the near layer 78 is preferably made significantly thicker or of heavier gauge than the far layer 80.

Figure 6:
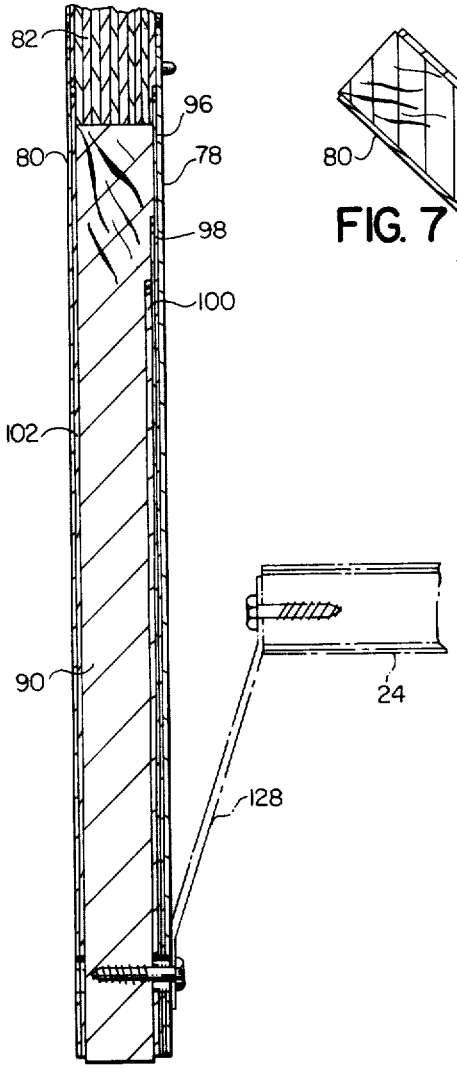
Figure 7:
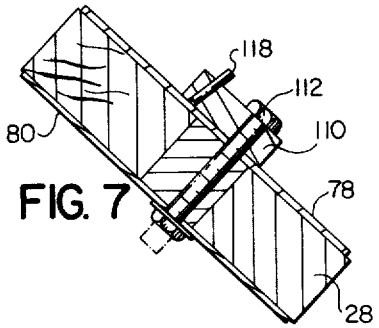
Figure 8:
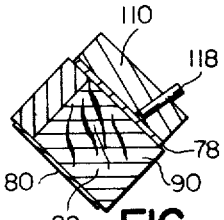

Obviously, the string panel 28 bears different amounts of stress at different areas. The panel may be designed with the face layers of sufficient thickness to satisfactorily support the maximum stress occurring at any point on it without any reinforcement. Preferably, however, and as shown, the face layers 78 and 80 are made thinner than this and reinforcing pieces are added to the face layers in critical areas. In the illustrated panel, one such critical area is the isthmus portion 94 extending between the panel openings 58 and 60. In this portion 94 the face panel 78, as shown in FIGS. 3 and 6, is reinforced by three reinforcing steel pieces or patches 96, 98 and 100 and the far face is reinforced by a single steel reinforcing piece 102. The reinforcing pieces are located in conforming rabbetted recesses in the core layer 76 and are bonded, by epoxy resin or the like, to one another, to the core layer and to their associated face plates 78 and 80.

Figure 9:
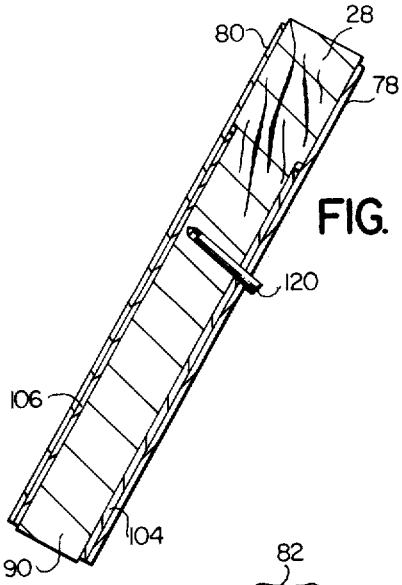

As shown in FIGS. 3 and 9 the lower left-hand corner of the panel 28 is also reinforced with a reinforcing piece 104 of sheet material adjacent the near layer 78 and another piece of reinforcing sheet material 106 adjacent the far layer 80 with both of the pieces 104 and 106 being received in conforming rabbetted recesses of the core layer and being bonded to both the core layer and their associated face layers. The placement of all of the reinforcing pieces in rabbetted recesses of the core layer 76 preserves a planar near surface on the panel 28 which may conveniently be used as a reference surface in the assembly of the piano. In particular, after joining the soundboard to the panel the flat near surface of the panel may be used to support a router or similar tool for trimming the near faces of the bridges 50, 52 and 54 to bring the bridges to desired heights corresponding to desired amounts of string down-bearing force on the bridges.

Prior to the bonding of the face layers 78 and 80 to the core layer 76 the face layers may be precut to provide for the openings 58, 60, etc., and the core layer 76 left uncut. The precut face layers and the reinforcing pieces may then be bonded to the core layer, using a suitable bonding agent such as an epoxy resin and then, after the bonding is completed, the openings 58, 60, etc., in the panel may be finished by using the precut edges of those openings in the face layers as templates or guides for cutting the core layer 76. This procedure is perhaps the better one to use when making string panels in relatively small volume. However, when making panels in larger volume more expensive tooling may be used to accurately precut the openings in both the face layers and the core layer. Also, in either case the material removed from the face layers in precutting the openings 58, 60, etc., is preferably used, as far as possible, in making the reinforcing pieces 96, 98, etc.

Figure 10:
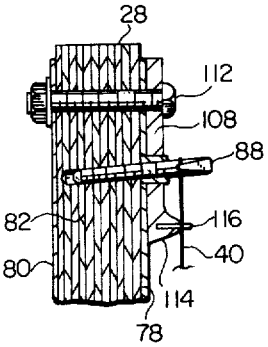
Figure 11:
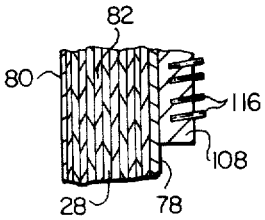
Figure 12:
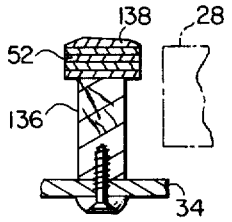
FIGS. 12 to 18 are fragmentary sectional views taken on the lines 12—12 to 18—18, respectively, of FIG. 4.

The bass strings 40, 40, that is the strings associated with the bass bridge 50, are strung over or in front of the remaining strings associated with the tenor and treble bridges 52 and 54. To accordingly space the bass strings farther from the near face 30 than the remaining strings, the panel includes an upper plate 108 in its upper left-hand corner and a lower bracket 110 near its lower right-hand corner both of which members are firmly attached to the body of the panel as by bolts 112, 112. Along its lower edge the upper plate 108 has a forwardly projecting ridge 114 carrying a row of forwardly projecting side bearing pins 116, 116, as shown in FIGS. 10 and 11. The lower bracket 110 in turn includes a corresponding number of hitch pins 118. The particular stringing arrangement used may vary widely from piano to piano, but for purposes of illustration in the piano 20 the bass set of strings comprises fifty-two strings and for each string there is one tuning pin 88, one nut pin 116 and one hitch pin 118, the nut pin 116 in conjunction with the bridge 50 determining the speaking length of the string.

The strings 40, 40 for the tenor bridge 52 and for the treble bridge 54 extend from other tuning pins 88, 88 located generally in the upper right-hand portion of the string panel to other hitch pins 120, 120 received directly in the panel 28 as shown in FIG. 9. Below the set of tenor and treble tuning pins 88, 88 as seen in FIG. 3, the panel 28 includes an nut bar 122 over which the strings pass and which in conjunction with the bridges 52 and 54 determines the speaking lengths of the strings. The strings are further held down and in tight engagement with the V-bar 122 by a pressure bar 124 held to the panel by a plurality of screws 126, 126. Also in the illustrated piano 20, the tenor and treble strings are strung so that the lower toned or longer ones have one end fixed to a tuning pin 88 and another end fixed to a hitch pin 120 and the higher toned or shorter ones have their two ends received respectively on two tuning pins and pass around a single hitch pin 120. Although not shown all three of the bridges include conventional pins on their top surfaces to properly associate the strings with the bridges.

The panel 28 is a sturdy, firm structure which may serve as a frame for supporting other parts of the piano. In the piano 20 advantage is taken of this by supporting at least part of the weight of the key bed 24 from the panel by means of two connecting brackets 128, 128 connected between the panel 28 and the key bed as shown in FIGS. 3 and 6.

It will also be noted that the strings 40, 40 are located relative to the panel 28 by pins and the like which fit in panel openings that in turn can be accurately located relative to the panel and accurately repeated from panel to panel by simple operations such as punching or drilling. Therefore, the string positions are accurately repeatable from panel to panel to such a degree that, if desired, the hammers of the action may possibly be preset to a standard condition prior to assembly of the action in the piano to avoid the now usual manual operation of custom setting the hammers.

FIGS. 4 and 12 to 18 show in detail the construction of the soundboard, its bridges 50, 52 and 54 and other associated parts. The bass bridge 50 includes a cantilevered base member 130 fixed to the soundboard, a web member 132 and a cap member 134. The tenor bridge 52 includes a web member 136 directly connected to the soundboard 34 and a cap member 138 while the treble bridge 54 includes a web member 140 directly connected to the soundboard 34 and a cap member 142. These bridge parts may be made of various materials such as metal or composites, but in the illustrated case all of the parts of the bridges are made of wood. The three web members of the three bridges preferably have their grain oriented in planes perpendicular to the soundboard so as to provide the bridge with a generally high modulus of elasticity, and each of the three cap members is preferably made of a number of laminations of wood with the grain of some laminations running parallel to the associated web member and with the grain of other laminations running perpendicular to the associated web member.

Figure 4:
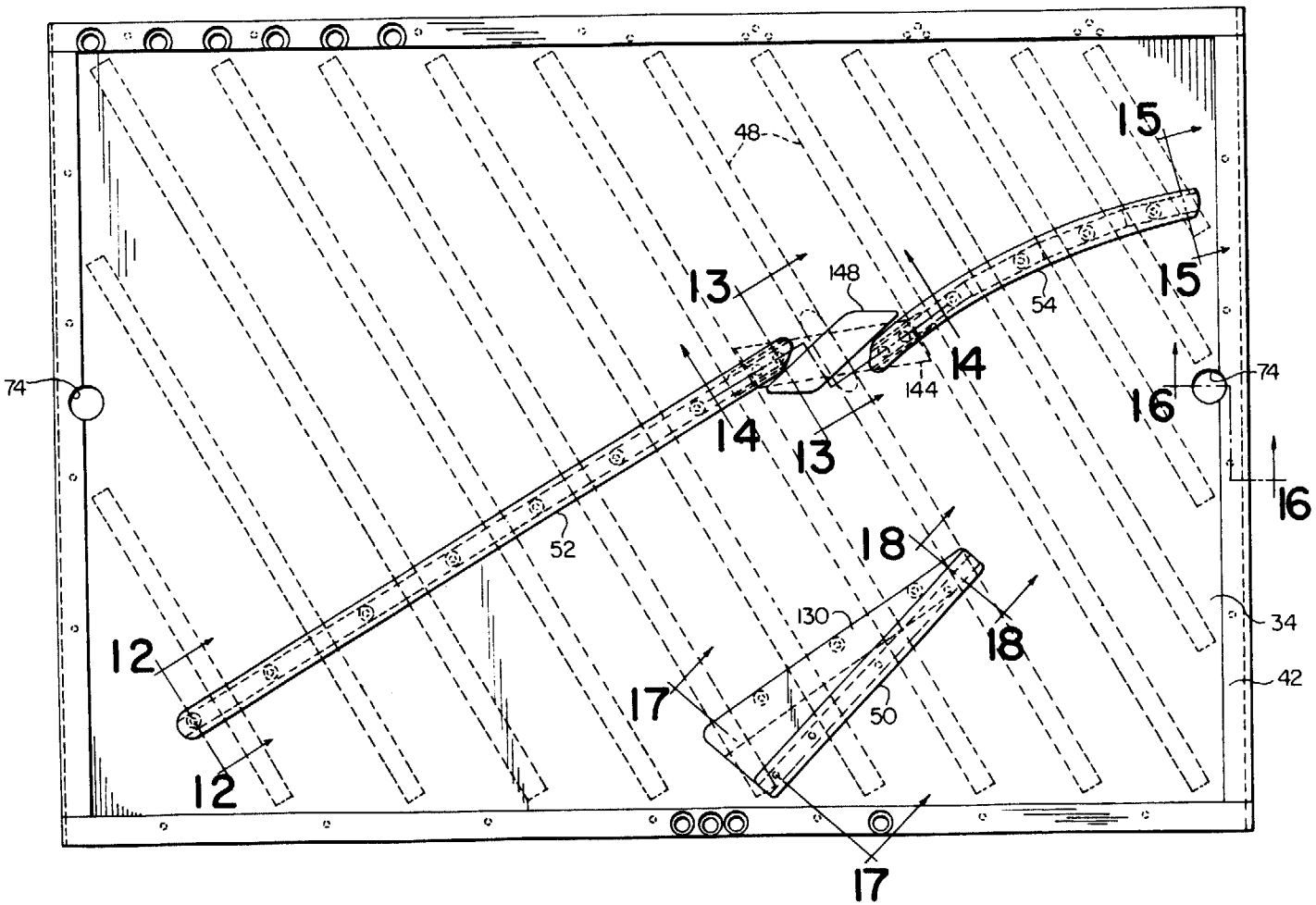
FIG. 4 is a plan view of the soundboard of the piano of FIG. 1.
Figure 13:
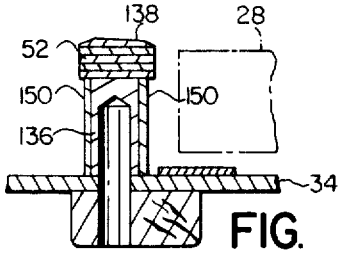
Figure 14:
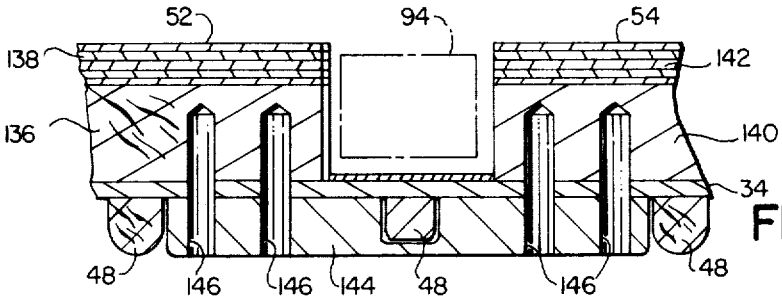
Figure 15:
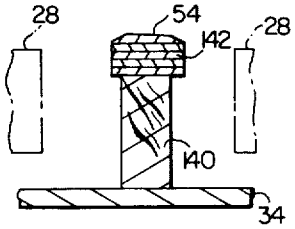
Figure 16:
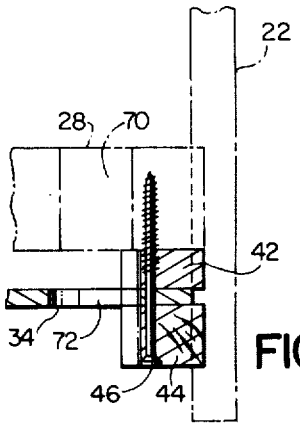
Figure 17:
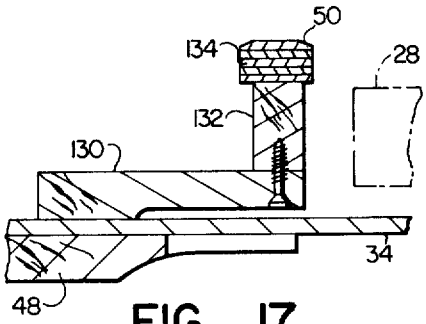
Figure 18:
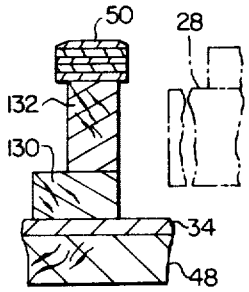

Some form of continuity is preferably provided between the tenor and treble bridges 52 and 54, and in the illustrated case such continuity is obtained by the soundboard 34 having attached to its far face a reinforcing member 144 of wood which spans the space between the adjacent ends of the two bridges and slightly overlaps their end portions. The reinforcing member is further directly connected to the two bridges by wooden dowels 146, 146 as shown in FIG. 14. Further, as shown in FIGS. 4 and 13 a thin reinforcing patch 148, in this case of wood, is glued to the near face of the soundboard between the end portions of the bridge, and the end portions of the bridge are also reinforced by reinforcing patches 150, 150, such as of wood, glued to the opposite sides of web member 140 and the web member 136.

Figure 19:
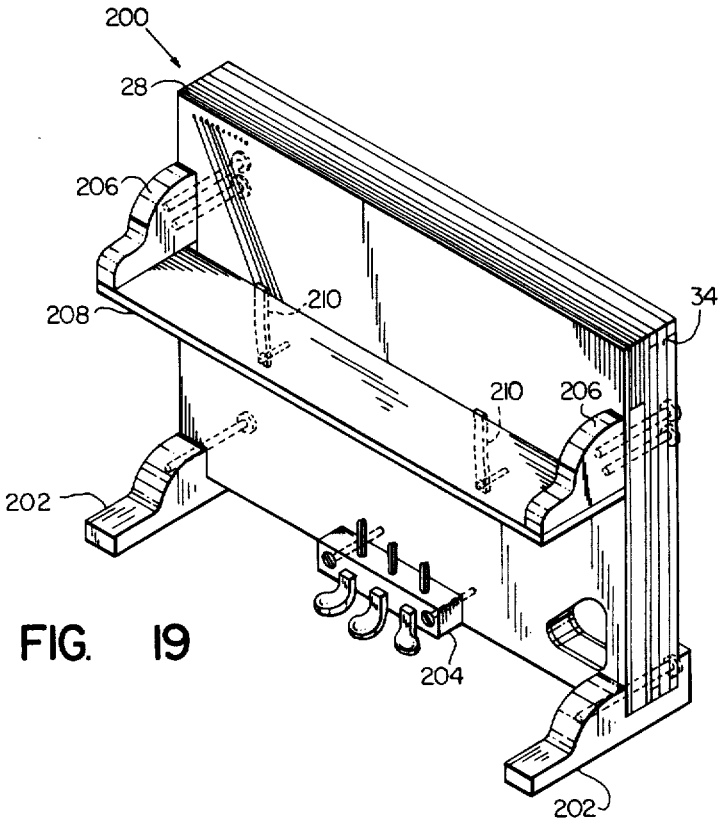
FIG. 19 is a perspective view showing a piano, in partially completed form, comprising another embodiment of this invention.

As mentioned previously the string panel 128 is a sturdy and firm structure which may be used as a frame to which other parts of the piano are attached. FIG. 19 shows another piano 200 in which large advantage is taken of this fact by using the string panel 28 as the main frame of the piano to which most or all other major components of the piano are directly attached. That is, in the piano 200, the string panel 128 has directly attached to it not only the soundboard 34 but also a pair of feet 202, 202, a pedal assembly 204 and two side cheeks 206, 206, all of which may be fixed to the panel 28 by suitable screws or other similar fasteners. Also, the key bed 208 is connected to the panel 28 through the use of two brackets 210, 210, each connected at opposite ends to the key bed and to the panel. Although not shown in FIG. 19 a suitable case, housing or other exterior dress may, of course, also be directly connected to the string panel 28 to protectively enclose the string panel and other portions of the piano or to improve its appearance.

Figure 20:
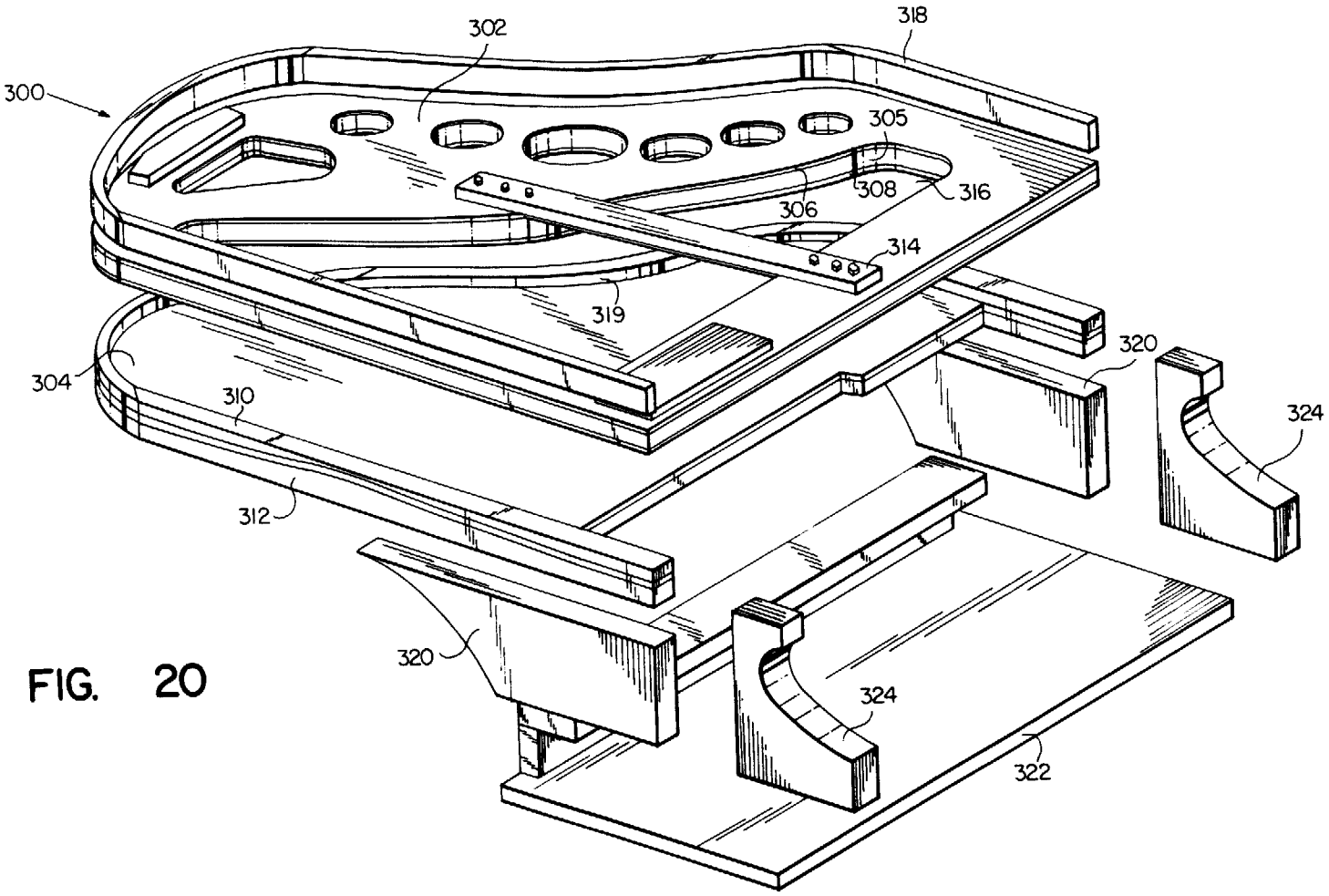
FIG. 20 is a exploded perspective view showing a piano, in partially completed form, comprising still another embodiment of this invention.

The pianos 20 and 200 are upright pianos but the string panel of this invention is not limited to such pianos and may instead be used for grand pianos or any other type of piano. FIG. 20, for example, shows a piano 300 using a string panel 302 and a soundboard 304 generally similar to the string panel 28 and soundboard 34 of the previously described upright pianos except for being placed horizontally and having the customary bent-U shape required for a grand piano. That is, the string panel 302 is of the same general sandwich construction as the string panel 28 of FIG. 1, it having a core layer 305 of wood or other low modulus of elasticity material and two face layers 306 and 308 of steel or other high modulus of elasticity material. The soundboard also has a set 310 of upper edge strips and a set 312 of lower edge strips which hold it in an upwardly bellied or crowned condition. One difference, however, between the piano 300 and and those previously described is that the isthmus portion of the panel 302 is strengthened by and includes a separate reinforcing bar 314, preferably made of steel or other metal, attached at its opposite ends to the body of the panel 302 on opposite sides of the opening 316 which accommodates the bridge 319 for the tenor and treble strings. The top steel layer 306 is left in place below the bar 314 and is bonded to the bar, and it may even have another layer of steel bonded to its lower face. The core layer 305 and lower steel layer 308 are, however, omitted below the bar 314. Of course, the isthmus construction of the previously illustrated upright string panel 28 could also be used in the grand piano 302 if desired, and the illustrated isthmus construction of the grand piano 302 could likewise be used in an upright panel if desired.

In the finished piano 300 the string panel 302 rests against the top surface of the upper set 310 of edge strips of the soundboard 304 and is fixed to such edge strings preferably both by bonding and screws. Also, above the string panel 302 is another set 318 of edge strips which are bonded to the top surface of the string panel. This set 318 of edge strips provides additional stability for the string panel 302 supplementing that provided by the steel face layers 306 and 308. The string panel 302 with its set 318 of edge strips therefore, together with the soundboard 304 and its sets 310 and 312 of edge strings, provides a rigid structure serving as a frame to which other parts of the piano are attached. This "frame" fits between two side panels 320, 320 which are attached by suitable means, such as screws, to it, and attached to the side pieces 320, 320 are a key bed 322 and two side cheeks 324, 324. The side surface of the frame, that is the unit consisting of the soundboard 304, the string panel 302, and sets 310, 312 and 318 of edge strings, which extends rearwardly beyond the side pieces 320, 320 may be left exposed or may be decoratively covered as by gluing to it a thin layer of wood veneer. A conventional lid, not shown, is also attached to the upper set 318 of edge strips to allow it to be opened and closed relative to the remainder of the piano in a conventional manner. With the addition of legs, a keyboard, an action and other minor components not shown in FIG. 20 the piano 300 is complete and, due to the strength of the string panel 302, does not require the heavy truss work normally located below the soundboard of prior grand pianos.

I claim:

1. A piano string panel assembly for carrying the strings of a piano, said panel assembly comprising a panel to which panel all of the ends of such strings may be anchored, said panel having a near face and a far face opposite and generally parallel to said near face, said panel also having at least one opening therein extending through its thickness between said near and far faces for accommodating the bridge or bridges of an associated soundboard, said panel throughout substantially all of its extent as surrounded by its outer peripheral edge comprising a relatively thick core layer of relatively low modulus of elasticity material having near and far faces, a near relatively thin face layer of relatively high modulus of elasticity material bonded to said near face of said core layer, and a far relatively thin face layer of relatively high modulus of elasticity material bonded to said far face of said core layer; and means for connecting all of the strings of a piano to said panel so that each string is supported at both of its ends by said panel for extension adjacent and parallel to said near panel face and so that each string extends over one of said at least one opening in said panel for cooperation with a bridge of the associated soundboard.

2. A piano string panel assembly for carrying the strings of a piano, said panel assembly comprising a panel to which panel all of the ends of such strings may be anchored, said panel having a near face and a far face opposite and generally parallel to said near face, said panel also having at least one opening therein extending through its thickness between said near and far faces for accommodating the bridge or bridges of an associated soundboard, said panel throughout substantially all of its extent as surrounded by its outer peripheral edge comprising a relatively thick core layer of material having near and far faces, a near relatively thin face layer of metal bonded to said near face of said core layer, and a far relatively thin face layer of metal bonded to said far face of said core layer; and means for connecting all of the strings of a piano to said panel so that each spring is supported at both of its ends by said panel for extension adjacent and parallel to said near panel face and so that each string extends over one of said at least one opening in said panel for cooperation with a bridge of the associated soundboard.

3. A piano string panel as defined in claim 2 further characterized by said thin face layers of said panel being made of steel.

4. A piano string panel as defined in claim 1, 2 or 3 further characterized by said core layer being made of wood.

5. A piano string panel as defined in claim 1, 2 or 3 further characterized by said core layer including a pin block portion and a remaining portion, said pin block portion and said remaining portion of said core layer being made of different materials, and said panel having a member of holes extending from said near face thereof to said pin block portion of said core layer for receiving tuning pins.

6. A piano string panel as defined in claim 5 further characterized by said pin block portion of said core layer being made of a number of laminations of hard wood arranged parallel to said near and far faces of said panel with the grain of at least some of said laminations being at an angle to the grain of other of said laminations.

7. A piano string panel as defined in claim 5 further characterized by said remaining portion of said core layer being made of glued up planks of wood.

8. A piano string panel as defined in claim 5 further characterized by said remaining portion of said core layer being made of a composite material including particles of wood.

9. A piano string panel as defined in claim 1, 2 or 3 further characterized by said near and far layers of said panel being made of the same material and said near layer being substantially thicker than said far layer.

10. A piano string panel as defined in claim 1, 2 or 3 further characterized by at least one piece of reinforcing sheet material bonded to one of said face layers of said panel, said piece of reinforcing sheet material being of substantially smaller size than the face layer to which it is bonded.

11. A piano string panel as defined in claim 1, 2 or 3 further characterized by said core layer including at least one rabbetted portion on one of its said faces, a piece of reinforcing sheet material located in said rabbetted portion between said core layer and the adjacent one of said face layers, and means bonding said piece of reinforcing sheet material to both said core layer and said adjacent one of said face layers.

12. A piano string panel as defined in claim 10 further characterized by said layer of reinforcing material being made of the same material as said face layers.

13. In a piano, the combination comprising:

a string panel with generally parallel near and far faces, a soundboard located adjacent and in generally parallel spaced relationship to said far face of said string panel, a plurality of strings extending over and adjacent to said near face of said string panel and having their opposite ends connected to said panel, and at least one bridge engaging at least some of said strings and said soundboard and extending from said strings to said soundboard, said string panel having an opening therein accommodating said bridge, said string panel throughout substantially all of its extent as surrounded by its outer peripheral edge comprising a relatively thick core layer of relatively low modulus of elasticity material having near and face faces, a near relatively thin face layer of relatively high modulus of elasticity material bonded to said near face of said core layer, and a far relatively thin face layer of relatively high modulus of elasticity material bonded to said far face of said core layer, and means for connecting a plurality of strings to said panel so as to be supported by said panel for extension adjacent and parallel to said near panel face and so that each of such strings extends over said opening and engages said bridge.

14. In a piano, the combination comprising:

a string panel with generally parallel near and far faces, a soundboard located adjacent and in generally parallel spaced relationship to said far face of said string panel, a plurality of strings extending over said near face of said string panel and having their opposite ends connected to said panel, and at least one bridge engaging at least some of said strings and said soundboard and extending from said strings to said soundboard, said string panel having an opening therein accommodating said bridge, said string panel throughout substantially all of its extent as surrounded by its outer peripheral edge comprising a relatively thick core layer of material having near and far faces, a near relatively thin face layer of metal bonded to said near face of said core layer and a far relatively thin face layer of metal bonded to said far face of said core layer; and means for connecting a plurality of strings to said panel so as to be supported by said panel for extension adjacent and parallel to said near panel face and so that each of such strings extends over said opening and engages said bridge.

15. The combination defined in claim 14 further characterized by said two face layers of said panel being made of steel.

16. The combination defined in claim 13, 14 or 15 further characterized by said core layer including a pin block portion comprised of laminations of hard wood, and a plurality of tuning pins associated with said strings and extending into said panel into said pin block portion of said core layer.

17. The combination defined in claim 13, 14 or 15 further characterized by said core layer including a pin block portion comprised of laminations of hard wood and a remaining portion constructed differently from said pin block portion but also made of wood, and a plurality of tuning pins associated with said strings and extending into said panel into said pin block portion of said core layer.

18. The combination defined in claim 17 further characterized by said remaining portion of said core layer being made of glued up planks of wood.

19. The combination defined in claim 13, 14 or 15 further characterized by said core layer including a pin block portion comprised of laminations of hard wood and a remaining portion made of composite material including particles of wood.

20. The combination defined in claim 13, 14 or 15 further characterized by said one bridge being one of two elongated bridges arranged generally in line and end to end with respect to one another with a space between their adjacent ends, said panel having two generally elongated holes for respectively accommodating said two bridges and which two holes are separated from one another by an isthmus portion of said panel passing between said spaced adjacent ends of said two bridges, at least one reinforcing piece of sheet material located against one of said face layers of said panel in said isthmus portion thereof, and means bonding said reinforcing piece to said one face layer.

21. The combination defined in claim 20 further characterized by said core layer of said panel being rabbetted to provide a recess for receiving said reinforcing piece of sheet material, said reinforcing piece of sheet material being located in said recess between said core layer and said one face layer, and means bonding said reinforcing piece to said core layer.

22. The combination defined in claim 20 further characterized by a second reinforcing piece of sheet material located against the other of said face layers in said isthmus portion of said panel, and means bonding said reinforcing piece to said other face layer.

23. The combination defined in claim 22 further characterized by said core layer being rabbetted to provide recesses for receving said reinforcing pieces of sheet material, said reinforcing pieces being located in said recesses between said core layer and their respectively associated face layers, and means bonding said reinforcing pieces to said core layer.

24. The combination defined in claim 20 further characterized by said soundboard having a near face engaged by said two bridges and a far face opposite from said near face, means fixing said two bridges to said soundboard, a reinforcing member engaging said far face of said soundboard and extending across said space between the adjacent ends of said two bridges and overlapping the adjacent end portions of said two bridges to some extent, and means fixing said reinforcing member to said soundboard.

25. The combination defined in claim 16 further characterized by said pin block portion of said core extending along a portion of the periphery of said panel, and said soundboard being of approximately the same perimetral size and shape as said panel so as to overlap substantially all of said panel including that portion thereof corresponding to said pin block portion of said core layer.

26. The combination defined in claim 13, 14 or 15 further characterized by said string panel and soundboard both being of generally rectangular shape and oriented vertically, said soundboard having a far face facing rearwardly of said piano, a plurality of elongated ribs attached to said far face of said soundboard, and means supporting said string panel and said soundboard so that said far face of said soundboard with said attached ribs forms in general the rear limit of said piano without any substantial structure being located rearwardly beyond said soundboard and ribs.

27. The combination defined in claim 26 further characterized by said string panel along each of its two vertical side margins having a bushing providing a hole extending horizontally through said panel between its said near and far faces, and two handle members each slidably received by a respective one of said bushings, said soundboard having holes aligned with those of said bushings to allow said handle members to move loosely through said soundboard, and each of said handle members being slidably movable relative to said string panel between an active position at which a relatively large portion thereof extends rearwardly beyond said soundboard to provide a handle grippable by a person moving said piano and an inactive position at which at most only a relatively small portion thereof extends rearwardly beyond said soundboard.

28. The combination defined in claim 13, 14 or 15 further characterized by means directly connecting said soundboard to said string panel, a pair of feet, and means directly connecting said pair of feet to said string panel.

29. The combination defined in claim 13, 14 or 15 further characterized by means directly connecting said soundboard to said string panel, a pair of side cheeks, a key bed extending between said side cheeks, and means directly connecting said side cheeks and key bed to said string panel.

30. The combination defined in claim 29 further characterized by a pair of feet, and means directly connecting said pair of feet to said string panel.

31. The combination defined in claim 29 further characterized by a pedal assembly, and means directly connecting said pedal assembly to said string panel.

* * * * *